United States Patent [19]

Sorensen

[11] Patent Number: 4,660,232

[45] Date of Patent: Apr. 28, 1987

[54] TOILET FLUSH VALVE

[76] Inventor: Ejnar Sorensen, P.O. Box 1362, Santa Monica, Calif. 90406

[21] Appl. No.: 843,259

[22] Filed: Mar. 24, 1986

[51] Int. Cl.[4] ..... E03D 5/09

[52] U.S. Cl. ..... 4/413; 4/401; 4/415

[58] Field of Search ..... 4/401, 403, 404, 413, 4/414, 415, 324

[56] References Cited

U.S. PATENT DOCUMENTS

| | | | |
|---|---|---|---|
| 1,013,225 | 1/1912 | Schulte | 4/401 |
| 1,729,546 | 9/1929 | Myers | 4/414 |
| 2,530,209 | 11/1950 | Sincomb | 4/401 |
| 2,534,705 | 12/1950 | Gertz | 4/414 |
| 2,549,700 | 4/1951 | Minton | 4/401 |
| 2,585,513 | 2/1952 | Stuvel | 4/401 |

*Primary Examiner*—Henry K. Artis
*Attorney, Agent, or Firm*—Herbert E. Kidder

[57] ABSTRACT

A toilet flush valve having a tank ball and rod, with a pair of guide arms mounted on the overflow pipe. The guide arms are spaced apart vertically a distance greater than half the length of the tank ball rod. The upper guide arm is located a fraction of an inch below the top end of the rod; and has a hole through which the rod passes. The hole is only slightly larger in diameter than the rod, so that the latter slides freely through the guide arm, but without appreciable side play. The lower guide is spaced above the tank ball a distance sufficient to allow the tank ball to rise clear of the outlet seat, and has a hole with diameter approximately 2 to 2.5 times the diameter of the rod, so that the latter has sufficient side clearance to allow the ball to center itself on its seat. A knob is attached to the rod between the guide arms closely adjacent the lower guide arm. A lift rod depends from the lift arm of the toilet handle, and its lower end extends between the knob and lower guide arm, and slidably engages the tank ball rod. When the arm is raised by the toilet handle, the lift rod engages and lifts the knob to unseat the ball. As the ball descends to its seat, the widely spaced guide arms accurately guide it so that it centers itself precisely on the seat.

2 Claims, 3 Drawing Figures

50
46
40
44
36
48
30
32
2
44
32
30
42
3
44
52
34
40
10
12
14
28
16
26
22
24
20
18
38

TOILET FLUSH VALVE

BACKGROUND OF THE INVENTION

The present invention pertains to toilet flush valves, and more particularly to flush valves of the type using a tank ball that is lifted off its annular seat and then subsequently descends as the tank empties, until it reseats on the valve seat.

Flush valves of the type described have been in widespread use for decades, and while they usually work satisfactorily for the first few years after being installed, they almost invariably become troublesome in time, due to lime deposits on the tank ball rod, and excessive wear in guides that are supposed to center the tank ball with respect to its seat as the ball descends. As a result, the tank ball either hangs up or fails to seat accurately, so that the tank continues to drain until the toilet handle is jiggled, or the tank ball is lifted manually and dropped onto its seat.

The problem is that the guides for the tank ball rod are so closely spaced or otherwise constructed that they have only a short length of sliding contact with the rod—usually only an inch or so. As the rod becomes encrusted with lime deposits, it becomes rough and abrasive, and repeated sliding motion of the rod through the guide holes causes wear, enlarging the guide holes. As the guide holes become enlarged, the guiding action becomes increasingly inaccurate, with the result that the tank ball is frequently dropped onto its seat off center. At other times, the tank ball rod will become canted at a slight angle in the enlarged holes of the guide, so that it hangs up and cannot drop back onto its seat. These malfunctions are the cause of many expensive repairs by plumbers, and are the source of much inconvenience and annoyance to the householder.

SUMMARY OF THE INVENTION

The primary object of the present invention is to provide a new and improved toilet flush valve that combines simplicity with total reliability, and is completely trouble-free. The present flush valve is simple and easy to install, and impossible to hang up or otherwise malfunction.

This object is achieved by providing two separate guide arms, preferably of stainless steel, which are mounted on the overflow pipe and project laterally therefrom. The guide arms are spaced apart vertically a distance at least equal to or greater than half the length of the tank ball rod, and their outer ends have holes provided therein through which the tank ball rod slides. The hole in the upper guide arm is only slightly larger in diameter than the rod, while the hole in the lower guide is preferably about 2 to 2.5 times the diameter of the rod. The close-fitting upper guide and looser-fitting lower guide provide accurate guidance of the tank ball rod, while allowing a very limited amount of lateral play so that the tank ball can center itself on its seat, even if the guide holes are slightly misaligned. A knob is attached to the rod between the guide arms closely adjacent the lower guide arm, and a lift rod depending from the lift arm of the toilet handle has its lower and extending between the knob and lower guide arm. When the arm is raised by the toilet handle, the lift rod engages and lifts the knob to raise the ball from its seat. As the ball descends to its seat, the widely spaced guide arms accurately guide it so that it centers itself precisely on the seat.

The foregoing and other objects and advantages of the invention will become apparent to those skilled in the art from the following detailed description of the preferred embodiment thereof, with reference to the accompanying drawings.

DESCRIPTION OF THE PREFERRED EMBODIMENT

Figures 1, 2, 3:
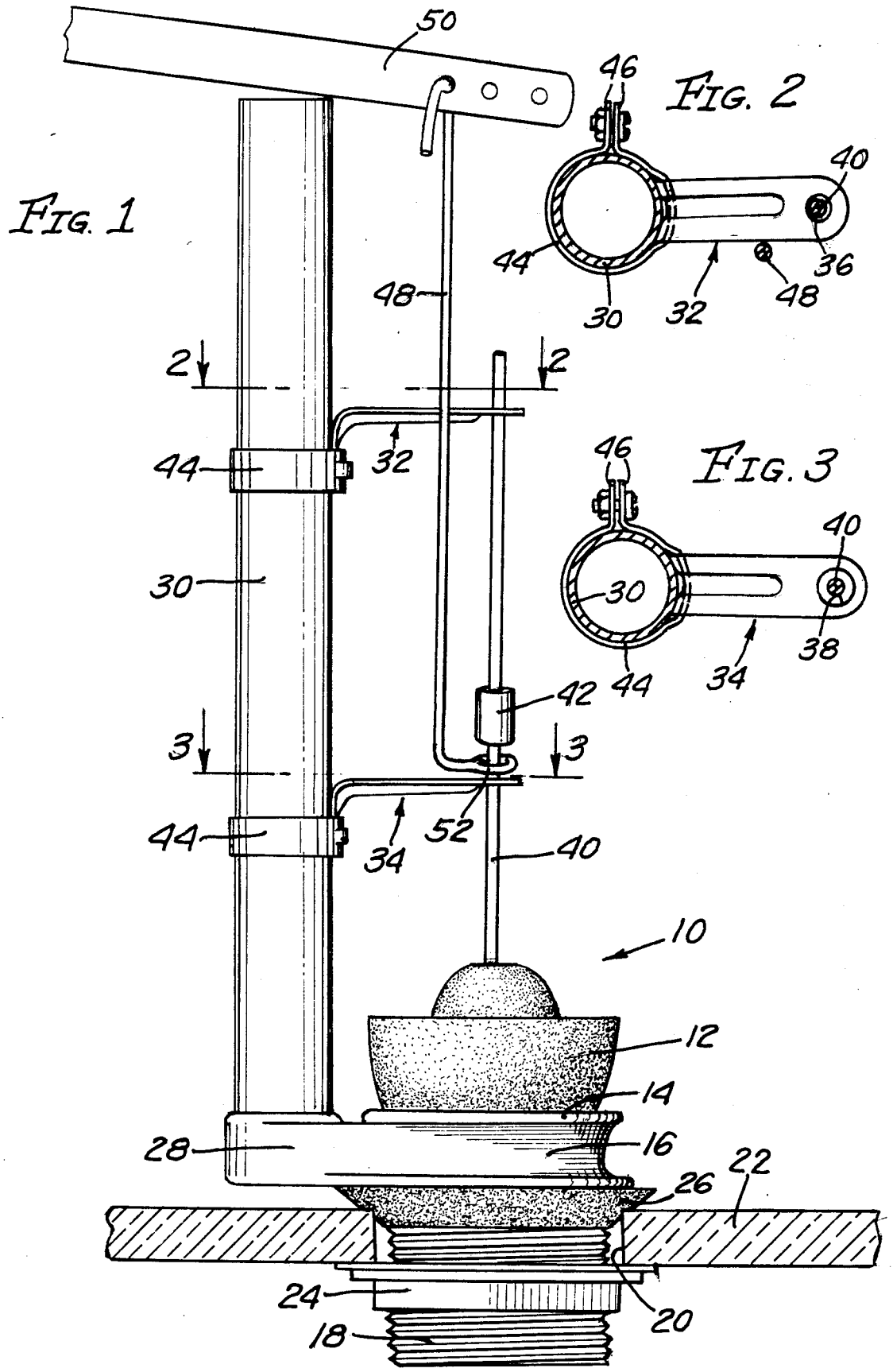
FIG. 1 is a side elevational view of a toilet flush valve embodying the invention.
FIG. 2 is a fragmentary sectional view, taken at 2—2 in FIG. 1.
FIG. 3 is a sectional view taken at 3—3 in FIG. 1.

In the drawings, reference numeral 10 designates the toilet flush valve in its entirety, which is seen to comprise a rubber tank ball 12 that seats on an annular outlet valve seat 14. The valve seat 14 is a part of a bronze casting 16 having a rather large diameter, threaded outlet pipe 18 extending downwardly through a hole 20 in the tank bottom 22. A nut 24 is screwed onto the threaded pipe 18 and bears against the underside of the tank bottom 22. A rubber sealing gasket 26 is interposed between the underside of the casting 16 and the tank bottom to seal the hole against water leakage.

A lateral projection 28 on one side of the casting 16 has an interior passageway (not shown) connected to the interior of the pipe 18, and screwed into a threaded hole in the top of the projection 28 is an overflow pipe 30.

Attached to the overflow pipe 30 are upper and lower guide arms 32 and 34, which are spaced apart vertically by a substantial distance, preferably in the neighborhood of about $3\frac{1}{2}$ inches, and the lower guide arm 34 is spaced about 2 inches above the highest point on the tank ball. The guide arms 32, 34 extend laterally from the overflow pipe, and their outer ends are directly over the center of the tank ball.

Formed in the outer ends of the guide arms are holes 36 and 38, through which a tank ball rod 40 extends and is slidable therein. The tank ball rod 40 is preferably of stainless steel, about $\frac{1}{8}$ inch in diameter, and its bottom end is screwed into a threaded insert in the tank ball.

As shown in FIG. 2, the hole 36 in upper guide arm 32 is only slightly larger in diameter than the rod 40, preferably about 5/32 inch, so that the $\frac{1}{8}$ inch rod slides freely but has virtually no side play in the hole.

In FIG. 3, the hole 38 of lower guide arm 34 is considerably larger in diameter than the rod 40, preferably about $\frac{1}{4}$ inch, so that the rod 40 has much more side play in the hole, than is the case with hole 36. Hole 38 should be from 2 to 2.5 times the diameter of the rod 40. This allows the rod to move a limited distance in all directions so as to permit the tank ball 12 to center itself on its seat 14 if the guide arm holes 36 and 38 are not located precisely over the center of the valve seat.

Mounted on the tank ball rod 40 between guide arms 32, 34 is a cylindrical knob 42, preferably of plastic, which is located with its bottom end about $\frac{1}{2}$ inch to $\frac{5}{8}$ inch above the lower arm 34. At this location, there is about $2\frac{1}{2}$ inches space between the top end of knob 42 and upper guide arm 36, which allows the tank ball to rise until it abuts against the lower guide arm 34 without knob 42 touching the upper guide arm 32.

The guide arms 32, 34 are identical in construction except for the different diameters of the holes 36, 38. Each comprises a collar 44 having out-turned ears 46 that are drawn together by a screw and nut. The collars 44 encircle the overflow pipe 30, and when tightened are securely locked in place. The guide arm, itself, is an L-shaped stamping, the shorter leg of which extends down between the collar 44 and the overflow pipe, and is locked to the collar by tabs. The longer leg of the L-shaped stamping extends horizontally outward from the overflow pipe and, as described earlier, the holes 36, 38 are vertically aligned with the center of the valve seat.

The tank ball is lifted from its valve seat to discharge the water in the tank, by means of an upper lift rod 48 which depends from the lift arm 50 closely alongside the rod 40. Lift arm 50 is attached to the toilet handle (not shown), and when the handle is turned by hand to flush the toilet, arm 50 is raised. The lower end of lift rod 48 is bent approximately 90° and is formed into a loop 52 that encircles the rod 40 between the bottom end of the knob 42 and lower guide arm 34. The upper lift rod 48 is adjusted on the lift arm 50 so that the bottom of loop 52 is almost touching the top of the lower guide arm 34, which leaves about $\frac{1}{4}$ inch to $\frac{3}{8}$ inch space between the top of loop 52 and the bottom surface of knob 42. This clearance ensures that the lift rod will not interfere with the seating of tank ball 12 on its seat 14.

The operation of the invention is believed to be more or less self-evident from the foregoing description and the drawings. When lift arm 50 is raised by the toilet handle, lift rod 48 engages and lifts knob 42, raising the tank ball from its seat. As soon as the tank ball is unseated, its buoyancy causes it to rise until it abuts against the lower guide arm, where it remains until the water level recedes to the point where the ball floats and descends with the water until it seats on the valve seat 14.

The superiority of the present invention over prior flush valves lies in the wide spacing of the guide arms 32, 34, together with the close-fitting guide hole 36 in the upper guide arm, and the somewhat looser-fitting guide hole 38 in the lower guide arm. These features provide extreme accuracy in guiding the tank ball down to its seat, while at the same time allowing a slight amount of side movement of the ball to compensate for any slight misalignment of the guide holes with respect to the center of the valve seat. The location of the knob 42 between the guide arms 32, 34 closely adjacent the lower guide arm enables the lift rod 48 to engage rod 40 close to the lower guide arm, and then when the toilet handle is released, the loop 52 drops back down to its position almost touching the top of lower guide arm 34, where it presents no resistance to the free sliding movement of rod 40. In contrast, the conventional toilet flush valve usually has the top end of its tank ball rod connected by a chain or link to the lift arm, and such chains or links are responsible for much of the trouble experienced with tank ball hangups.

While I have shown and described the preferred form of my invention in considerable detail, it will be apparent to those skilled in the art that the invention is not limited to such details, but might take various other forms within the scope of the appended claims.

What I claim is:

1. A toilet flush valve for use with a toilet tank having an outlet valve seat, an overflow pipe, and a handle-operated lift arm, comprising:

a buoyant tank ball that seats on the outlet valve seat;

a rod attached to said tank ball and extending vertically upward therefrom;

a pair of widely spaced guide arms fixed to the overflow pipe and extending horizontally therefrom over the outlet valve seat, said guide arms having guide holes in their outer ends through which said rod slides freely;

the guide hole in the upper guide arm being only slightly larger in diameter than said rod, by an amount of the order of 25% greater than the rod's diameter, so that the rod slides freely therein without appreciable side play, and the guide hole in the lower guide arm being substantially larger in diameter than the rod, by an amount of the order of 2 to 2.5 times the diameter of the rod, so that the rod has appreciable side play to allow the tank ball to center itself on the valve seat in the event that the tank ball is slightly misaligned with respect to the valve seat;

a knob attached to said rod closely adjacent the lower guide arm; and a lift rod depending from the lift arm and having a formation at its lower end slidably engaging said tank rod between the lower guide arm and said knob, said formation being operable to engage the bottom of the knob to lift said tank ball rod and raise said tank ball from its seat when the lift arm is raised.

2. A toilet flush valve as set forth in claim 1, wherein each of said guide arms comprises a split collar surrounding the overflow pipe, with outstanding ears clamped together by a screw and nut; and an L-shaped arm having a first leg that extends downwardly between said collar and the overflow pipe, and a second leg that extends horizontally outward from the overflow pipe; said first leg being attached to said collar to form a single unitary structure.

* * * * *